US007300496B2

(12) United States Patent
Taylor

(10) Patent No.: US 7,300,496 B2
(45) Date of Patent: Nov. 27, 2007

(54) METHODS AND APPARATUS FOR AIR POLLUTION CONTROL

(75) Inventor: Robert W. Taylor, Overland Park, KS (US)

(73) Assignee: General Electric Company, Schenectady, NY (US)

( * ) Notice: Subject to any disclaimer, the term of this patent is extended or adjusted under 35 U.S.C. 154(b) by 257 days.

(21) Appl. No.: 11/011,021

(22) Filed: Dec. 10, 2004

(65) Prior Publication Data

US 2006/0123986 A1 Jun. 15, 2006

(51) Int. Cl.
*B03C 3/019* (2006.01)

(52) U.S. Cl. ..... 95/58; 95/64; 95/70; 95/71; 96/52; 96/55

(58) Field of Classification Search ..... 95/58, 95/64, 71, 70; 96/52–53, 55; 55/DIG. 25
See application file for complete search history.

(56) References Cited

U.S. PATENT DOCUMENTS

| | | | | |
|---|---|---|---|---|
| 2,935,375 | A * | 5/1960 | Boucher | 423/210 |
| 3,372,528 | A * | 3/1968 | Hoff | 96/19 |
| 3,874,858 | A * | 4/1975 | Klugman et al. | 96/47 |
| 4,042,348 | A * | 8/1977 | Bennett et al. | 95/60 |
| 4,533,364 | A * | 8/1985 | Altman et al. | 95/58 |
| 4,935,209 | A | 6/1990 | Pfoutz | 422/128 |
| 5,024,681 | A | 6/1991 | Chang | 95/70 |
| 5,158,580 | A | 10/1992 | Chang | 95/70 |
| 5,240,470 | A * | 8/1993 | Wright | 95/58 |
| 5,300,270 | A * | 4/1994 | Krigmont et al. | 423/239.1 |
| 5,424,044 | A * | 6/1995 | Kalka | 422/171 |
| 5,505,766 | A | 4/1996 | Chang | 95/134 |
| 5,547,493 | A | 8/1996 | Krigmont | 96/54 |
| 5,567,226 | A * | 10/1996 | Lookman et al. | 95/3 |
| 5,601,791 | A | 2/1997 | Plaks et al. | 422/169 |
| 5,707,428 | A | 1/1998 | Feldman et al. | 96/54 |
| 5,893,943 | A | 4/1999 | Durham et al. | 95/65 |
| 6,267,802 | B1 * | 7/2001 | Baldrey et al. | 95/58 |
| 6,514,315 | B1 | 2/2003 | Chang | 95/70 |

FOREIGN PATENT DOCUMENTS

| | | | |
|---|---|---|---|
| EP | 0 009 857 | A2 | 4/1980 |
| WO | WO 01/34854 | A2 | 5/2001 |
| WO | WO 02/42003 | A1 | 5/2002 |
| WO | WO 2004/096420 | A1 | 11/2004 |

* cited by examiner

*Primary Examiner*—Richard L. Chiesa
(74) *Attorney, Agent, or Firm*—Armstrong Teasdale LLP

(57) ABSTRACT

A method for filtering particle-laden gas includes electrostatically precipitating particles from the particle-laden gas to produce a gas having residual particulates, agglomerating the residual particulates, and using a fabric filter to filter the agglomerated residual particulates from the gas.

25 Claims, 2 Drawing Sheets

METHODS AND APPARATUS FOR AIR POLLUTION CONTROL

BACKGROUND OF THE INVENTION

This invention relates generally to methods and apparatus utilizing agglomeration to improve the performance of baghouses installed in series with an electrostatic precipitator, and to systems utilizing such methods and apparatus.

In some known industrial plant air pollution control systems, an electrostatic precipitator and fabric filter are combined to allow a baghouse to operate at a higher air to cloth ratio than does a fabric filter that experiences a full dust burden of a process gas stream. The electrostatic precipitator is intended to reduce the dust burden reaching the fabric filter. As a result of the reduced dust burden, some designers increase the air to cloth ratio of the fabric filter, enabling the fabric filter to be relatively compact (i.e., less cloth area for a given gas volume). The expectation is that the baghouse can operate at an acceptable pressure drop even though significantly greater volumes of gas are forced through every square foot of cloth filter.

In practice, however, baghouses operating in series with an electrostatic precipitator to reduce particulate emissions experience high pressure drop and short bag life in comparison to conventional fabric filters. These conditions result because the electrostatic precipitator removes 95% or more of the incoming dust and essentially all coarse particles, so the dust that enters the fabric filter is extremely fine. This extremely fine dust creates a dense dust cake, which over a period of time becomes embedded in the fibers of the filtration media, causing permanent increases in pressure drop. Operators attempt to recover the pressure drop by increasing pressure used to pulse the bags and by reducing intervals between cleaning cycles. However, this mode of operation results in reduced bag life due to fabric fatigue.

Some known systems utilize a compact hybrid particulate collector (COHPAC), which is described in U.S. Pat. No. 6,514,315, "Apparatus and Method for Collecting Flue Gas Particulate With High Permeability Filter Bags," issued to Ramsay Chang on Feb. 4, 2003 and assigned to the Electric Power Research Institute, Inc. (EPRI), Palo Alto, Calif. and other patents. In some of these configurations, fabric filters operate at an air to cloth ratio of 8 ft/min (2.4 m/min) or higher and the filters are installed in series with an existing electrostatic precipitator. COHPAC installations can experience undesirable bag blinding and pressure drop. By using a higher permeability fabric and operating at air to cloth ratios of 6 ft/min (1.8 m/min) or less (i.e., below the range stated in the EPRI patent), bag blinding and pressure drop are reduced. However, part of the cost of this reduction is a trade-off with emission compliance.

BRIEF DESCRIPTION OF THE INVENTION

The present invention provides, in one aspect, a method for filtering particle-laden gas. The method includes electrostatically precipitating particles from the particle-laden gas to produce a gas having residual particulates, agglomerating the residual particulates, and using a fabric filter to filter the agglomerated residual particulates from the gas.

In another aspect, the present invention provides an apparatus for filtering particle-laden gas. The apparatus includes an electrostatic precipitator, a particle agglomerator, and a fabric filter, wherein the particle agglomerator is configured to agglomerate residual particles remaining in the gas leaving the electrostatic precipitator prior to passage of the gas through the fabric filter.

In yet another aspect, the present invention provides an industrial plant system that includes a burner, an electrostatic filter configured to filter particle-laden gas from the burner, a particle agglomerator configured to agglomerate residual dust particles in the filtered gas, and a baghouse having a fabric filter. The fabric filter is configured to filter exhaust gas having the agglomerated dust particles from the particle agglomerator.

In still another aspect, the present invention provides a method for filtering particle-laden gas having dust particles having a distribution of sizes suspended therein. The method includes preprocessing the particle-laden gas to remove a portion of the dust particles suspended therein and to skew the particle size distribution of particles remaining suspended in the preprocessed gas towards smaller particles. The method also includes further processing the preprocessed gas to increase the sizes of particles suspended therein, and filtering the further processed gas using a fabric filter.

By increasing the particle size of dust entering the fabric filter in various configurations of the present invention, problems associated with the series application of an electrostatic precipitator and baghouse are reduced or eliminated.

DETAILED DESCRIPTION OF THE INVENTION

In some configurations of the present invention, particle size is increased prior to entering a fabric filter. By increasing the particle size of dust entering the fabric filter, problems associated with the series application of an electrostatic precipitator and baghouse are reduced or eliminated. Thus, some configurations of the present invention preprocess particle-laden gas to remove a portion of the dust particles suspended therein and to skew the particle size distribution of particles remaining suspended in the preprocessed gas towards smaller particles. The preprocessed gas is further processed to increase the sizes of particles suspended therein, and the further processed gas is then filtered using a fabric filter.

The particle size is increased in some configurations of the present invention using an agglomerator. The method by which agglomeration is accomplished is not critical to the practice of the present invention, and can include, for example, injection of chemicals that promote agglomeration of dust (such as ammonia) and/or application of electrostatic forces for the purpose of charging incoming dust particles.

Figure 1:
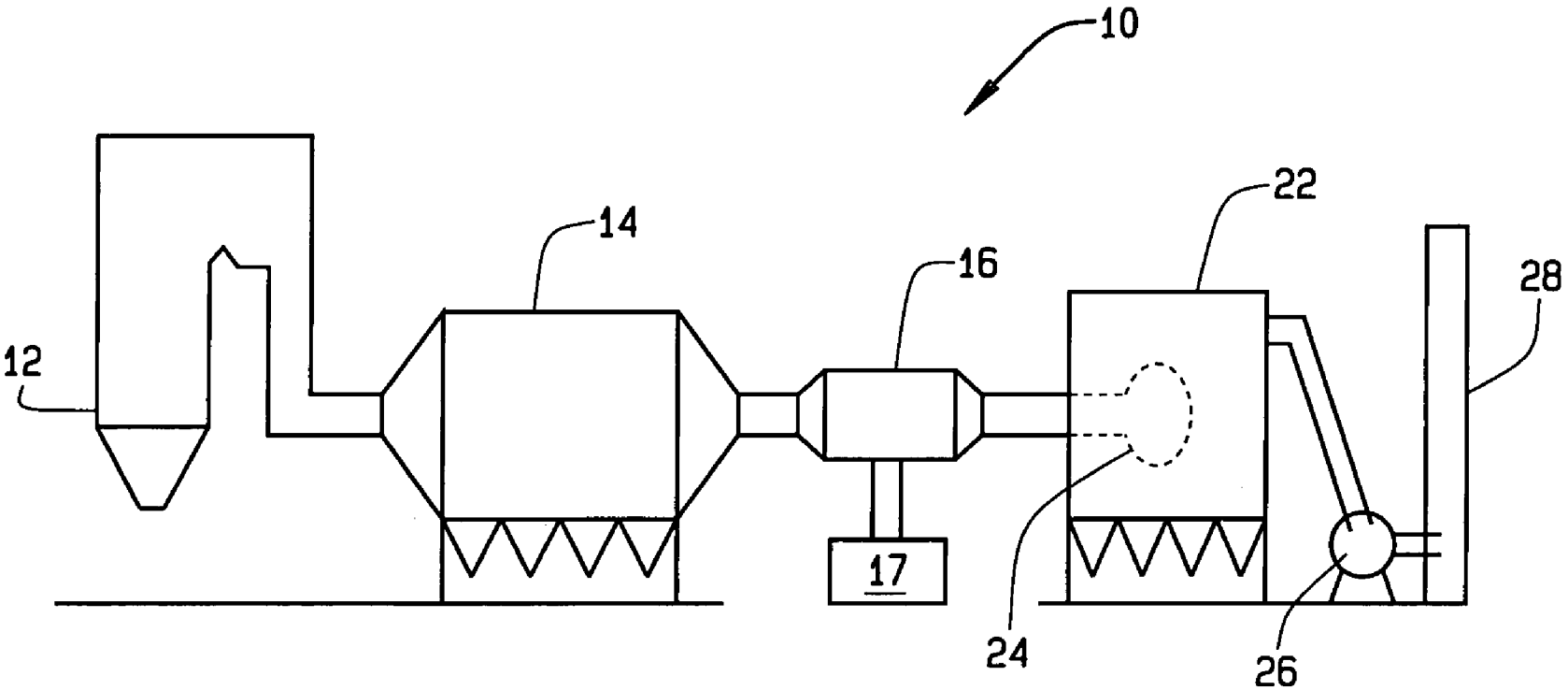
FIG. 1 is a schematic diagram of an industrial plant system in which a particle-laden gas that has been preprocessed by electrostatic precipitation is passed through a particle agglomerator to increase the size of the residual dust particles prior to being filtered in a fabric filter in a baghouse.

In some configurations and referring to FIG. 1, in an industrial plant system 10, a combustion source 12 uses a solid fuel fired combustion process. Combustion source 12, for example, comprises a utility boiler, an incinerator, or a waste to heat facility. The fuel source, for example, comprises waste products and/or solid fossil fuels. Dust-laden gas having dust created during the combustion process exits combustion source 12 and enters an electrostatic precipitator 14. Electrostatic precipitator 14, for example, comprises a fractional collection device that charges particles for collection onto one or more grounded surfaces. In some configurations, about 95% to over 99% of incoming dust is removed. Coarse particles are removed quickly, whereas fine dust typically requires significantly more treatment time for collection. As a result, the particle size distribution of dust exiting electrostatic precipitator 14 is skewed towards small-sized particles. Typically, dust entering an existing electrostatic precipitator 14 has a mean diameter of between about 8 to about 25 microns, with a standard deviation of about 3.5 microns. Dust exiting an existing electrostatic precipitator 14 typically has a mean diameter of between about 1.0 to 2.0 microns, with a standard deviation of about 0.5 microns.

In some configurations of the present invention, gas having residual dust particles suspended therein exiting electrostatic precipitator 14 enters a particle agglomerator 16. Particle agglomerator 16 can be installed in existing systems 10 or provided with new installations. Any of the various types of particle agglomerators can be used for particle agglomerator 16. For example, in some configurations, agglomerator 16 is configured to chemically agglomerate particles. One example of an agglomerator that operates chemically is an ammonia injection agglomerator, which creates a sticky layer on dust particles that cause them to agglomerate by injecting ammonia from a reservoir 17 into the gas stream in the agglomerator. Another type of particle agglomerator 16 that can be used in configurations of the present invention is an electrostatic particle agglomerator. In one configuration of electrostatic agglomerator, dust enters a chamber that is divided into a plurality of sections. Each section is charged using a corona generation device, so that about half of the particles are charged positively and the other half are charged negatively. When the oppositely charged particles are mixed, they agglomerate into larger particles.

Figure 2:
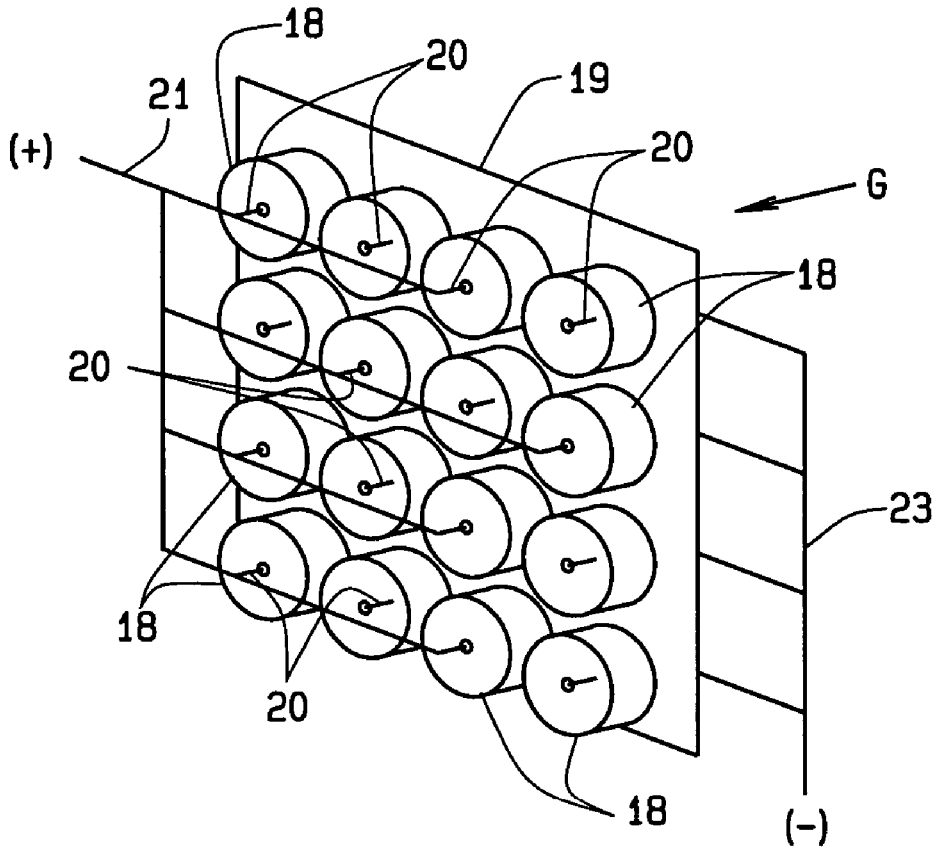
FIG. 2 is a drawing of one of several types of particle agglomerators useful as the particle agglomerator in FIG. 1.
Figure 3:
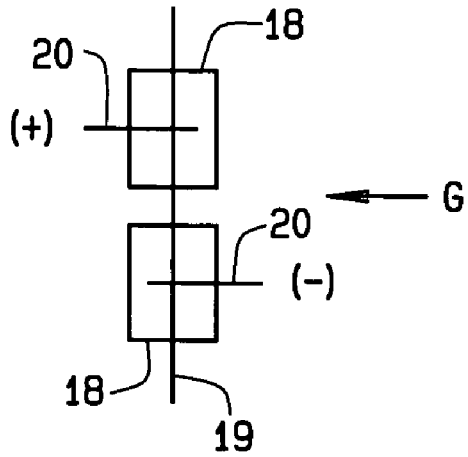
FIG. 3 is a cross sectional detail of a portion of the agglomerator shown in FIG. 2.

In some configurations and referring to FIG. 2, agglomerator 16 comprises a series of cylinders 18 held in a flat plate 19 that is perpendicular to a passing gas flow G. (Gas flow G is the gas flow out of electrostatic precipitator 14 having the residual particles remaining.) Each cylinder 18 has an axis parallel to gas flow G and perpendicular to the plane of flat plate 19. In some configurations, each cylinder 18 is approximately 10 inches (25.4 cm) in diameter, and has a discharge electrode 20 along its radial axis. Discharge electrodes 20 form two grids 21 and 23 that are oppositely charged to provide a high voltage corona to electrodes 20. Electrodes 20 are arranged so that every other cylinder 18 has an oppositely charged electrode 20. Thus, that portion of flow G that exits any cylinder 18 mixes with the flow from adjacent cylinders 18 that have oppositely charged electrodes. The mixing allows fine dust to agglomerate onto coarser particles in flow G and thereby at least partially eliminates fine dust in flow G.

Air containing the agglomerated particles leaves agglomerator 16 (of whatever type) and enters baghouse 22, which includes a fabric filter 24 that serves as a particle removal device by filtering out agglomerated particles. Extremely fine dust particles in a stream entering filter 24 would tend to become bound or embedded in filter 24. This extremely fine dust creates a dense dust cake, which over a period of time becomes embedded in the fibers of filtration media 24, causing permanent increases in pressure drop. Operators attempt to recover the pressure drop by increasing pressure used to pulse the bags and by reducing intervals between cleaning cycles. However, this mode of operation results in reduced bag life due to fabric fatigue. Because agglomerator 16 is configured to process residual dust that leaves precipitator 14, the extremely fine residual dust remaining in the precipitator 14 exhaust stream is converted into a form that advantageously prevents filter 24 from becoming burdened with an embedded dust cake. Thus, fabric fatigue can be avoided and bag life is increased.

In some configurations, baghouse 22 is the final device in the exhaust stream that has a filtering function. It is advantageous, as explained above, to provide a fabric filter 24 that has as high an air to cloth ratio as possible. Typically, in existing baghouses 22, pulse jet fabric filters 24 used to filter combustion processes are designed for air to cloth ratios of about 3 ft/min to about 4 ft/min (about 0.9 m/min to about 1.2 m/min). At this air to cloth ratio, a typical baghouse experiences a pressure drop of about 6 to about 8 inches (about 0.15 m to 0.20 m) water column. Pulse cleaning cycles vary from about 20 minutes to about 120 minutes. By contrast, in some configurations of the present invention, air to cloth ratios of 6 ft/min (1.8 m/min) or higher are used. For example, in some configurations, an air to cloth ratio of 8 ft/min (2.4 m/min) is used.

A fan 26 is used in some configurations of the present invention to overcome pressure drops associated with fabric filter 24 and other equipment in the gas stream, and processed gas (i.e., exhaust gas with particulates removed) exits through a stack 28.

It will thus be appreciated by those skilled in the art that problems associated with the series application of an electrostatic precipitator and a baghouse, including pressure drop and clogging of fabric filters, are reduced or eliminated by various configurations of the present invention by increasing the particle size of dust entering the fabric filter.

While the invention has been described in terms of various specific embodiments, those skilled in the art will recognize that the invention can be practiced with modification within the spirit and scope of the claims.

What is claimed is:

1. A method for filtering particle-laden gas comprising:
- electrostatically precipitating particles from the particle-laden gas to produce a gas having residual particles;
- agglomerating the residual particles comprising:
  - inducing an electrostatic charge having a first polarity on a first portion of the residual particles and inducing an electrostatic charge having a second polarity on a second portion of the residual particles; and
  - merging the first portion of the residual particles and the second portion of the residual particles with each other; and
- using a fabric filter to filter the agglomerated residual particles from the gas.

2. A method in accordance with claim 1 wherein said agglomerating the residual particles further comprises chemically agglomerating the residual particles.

3. A method in accordance with claim 2 wherein said chemically agglomerating the residual particles comprises injecting an agglomerating chemical into the gas after particles have been electrostatically precipitated from the particle-laden gas.

4. A method in accordance with claim 2 wherein the agglomerating chemical comprises ammonia.

5. A method in accordance with claim 1 wherein said agglomerating the residual particles comprises electrostatically agglomerating the residual particles.

6. A method in accordance with claim 5 wherein electrostatically agglomerating the residual particles comprises passing gas with the residual particles through a series of cylinders having a radial axis parallel to the gas flow, wherein every other cylinder has an oppositely charged electrode, and merging the residual particles as they pass through the cylinders.

7. A method in accordance with claim 1 wherein said agglomerating the residual particles comprises retrofitting an agglomerator between an existing electrostatic precipitator and an existing baghouse.

8. A method in accordance with claim 1 wherein said using a fabric filter to filter the agglomerated residual particles from the gas comprises passing the exhaust gas through a fabric filter in a baghouse at an air to cloth ratio of greater than 1.8 m/min.

9. A method in accordance with claim 8 wherein the air to clot ratio is about 2.4 m/min.

10. An apparatus for filtering particle-laden gas, said apparatus comprising an electrostatic precipitator, a particle agglomerator, and a fabric filter, wherein said particle agglomerator configured to agglomerate residual particles remaining in the gas leaving said electrostatic precipitator prior to passage of the gas through said fabric filter, wherein said particle agglomerator comprising a series of cylinders having a radial axis parallel to a direction of gas flow, wherein every other said cylinder has an oppositely charged electrode, and said particle agglomerator further configured to merge the residual particles as they pass through said cylinders.

11. An apparatus in accordance with claim 10 wherein said particle agglomerator is further configured to chemically agglomerate the residual particles.

12. An apparatus in accordance with claim 11 wherein said particle agglomerator is further configured to chemically agglomerate the residual particles utilizing ammonia.

13. An apparatus in accordance with claim 10 wherein said particle agglomerator configured to electrostatically agglomerate the residual particles.

14. An apparatus in accordance with claim 10 further comprising a baghouse housing said fabric filter.

15. An apparatus in accordance with claim 14 further configured to pass gas through said fabric filter at an air to cloth ratio of greater than 1.8 m/min.

16. An apparatus in accordance with claim 14 further configured to pass gas through said fabric filter at an air to cloth ratio of about 2.4 m/sec.

17. An apparatus in accordance with claim 10 further comprising a fan configured to overcome a pressure drop associated with said fabric filter.

18. An apparatus in accordance with claim 17 further comprising a stack configured to exhaust processed gas from said apparatus.

19. An industrial plant system comprising:

a burner;

an electrostatic filter configured to filter particle-laden gas from said burner;

a particle agglomerator configured to agglomerate dust particles in the filtered gas leaving said electrostatic filter, wherein said particle agglomerator comprises a series of cylinders having a radial axis parallel to a direction of gas flow, wherein every other said cylinder has an oppositely charged electrode, and said particle agglomerator further configured to merge the residual particles as they pass through said cylinders; and a baghouse having a fabric filter configured to filter exhaust gas having the agglomerated dust particles from said particle agglomerator.

20. A system in accordance with claim 19 configured to pass gas through said fabric filter at an air to cloth ratio of greater than 1.8 m/min.

21. A system in accordance with claim 19 configured to pass gas through said fabric filter at an air to cloth ratio of about 2.4 m/sec.

22. A system in accordance with claim 19 further comprising a fan configured to overcome a pressure drop associated with said fabric filter.

23. A system in accordance with claim 22 further comprising a stack configured to exhaust processed gas from said apparatus.

24. A system in accordance with claim 19 wherein said particle agglomerator is further configured to chemically agglomerate the residual particles.

25. A system in accordance with claim 19 wherein said particle agglomerator configured to electrostatically agglomerate the residual particles.

* * * * *